US008997870B2

(12) United States Patent
McAllister et al.

(10) Patent No.: US 8,997,870 B2
(45) Date of Patent: Apr. 7, 2015

(54) METHOD AND APPARATUS FOR SEPARATING DOWNHOLE HYDROCARBONS FROM WATER

(75) Inventors: Norman J. McAllister, Calgary (CA); Stuart D. McAllister, Calgary (CA)

(73) Assignee: Canada West Resources Inc., Calgary (CA)

( * ) Notice: Subject to any disclaimer, the term of this patent is extended or adjusted under 35 U.S.C. 154(b) by 533 days.

(21) Appl. No.: 13/138,951

(22) PCT Filed: Apr. 30, 2010

(86) PCT No.: PCT/CA2010/000676
§ 371 (c)(1),
(2), (4) Date: Oct. 31, 2011

(87) PCT Pub. No.: WO2010/124394
PCT Pub. Date: Nov. 4, 2010

(65) Prior Publication Data

US 2012/0043088 A1 Feb. 23, 2012

(30) Foreign Application Priority Data

Apr. 30, 2009 (CA) ..... 2665035

(51) Int. Cl.
*E21B 34/00* (2006.01)
*E21B 43/38* (2006.01)

(52) U.S. Cl.
CPC ..... *E21B 43/385* (2013.01)

(58) Field of Classification Search
CPC ..... E21B 43/385; F16K 15/14; F16K 15/141; F16K 15/142
USPC ..... 166/325, 326, 313, 265, 266, 105.5, 166/242.3, 184, 369; 137/512.15, 853; 210/170.01, 170.07, 532, 1, 538, 540
See application file for complete search history.

(56) References Cited

U.S. PATENT DOCUMENTS 3,294,108 A * 12/1966 Thrash ..... 137/155
2011/0024110 A1* 2/2011 Ramsely ..... 166/265

* cited by examiner

*Primary Examiner* — Shane Bomar
*Assistant Examiner* — George Gray
(74) *Attorney, Agent, or Firm* — George A. Seaby

(57) ABSTRACT

An apparatus for downhole separation of an oil/water fluid and the injection of the separated water into the formation includes a casing in a borehole, a tubing string in the casing, first perforations in the casing at a production zone in the borehole for admitting the mixture into an annulus between the casing and the tubing string, second perforations in the tubing string for admitting production fluid from the casing into the tubing string, third perforations in the casing for discharging separated water from the annulus into the formation, a packer in the annulus separating the first perforations from the third perforations, a first check valve in the tubing string above the packer for admitting the mixture from the tubing string into the annulus where water separates by gravity from the hydrocarbons for discharge through the third perforations, and a second check valve in the tubing string above the first check valve for admitting separated hydrocarbons from the annulus into the tubing string for passage to the top of the borehole.

5 Claims, 14 Drawing Sheets

METHOD AND APPARATUS FOR SEPARATING DOWNHOLE HYDROCARBONS FROM WATER

BACKGROUND OF THE INVENTION

This invention relates to a method and apparatus for downhole separation of hydrocarbons and water in oil and gas well fluid mixtures and returning the water to the production formation.

FIELD OF THE INVENTION

Downhole hydrocarbon fluids from water separators reduce the need and associated costs of bringing produced water to the surface, and permit direct downhole water disposal. Differing approaches have been developed for downhole separation of oil and water, and the gravity method appears to have been dominant, taking advantage of the difference in density of oil, gas and water.

DESCRIPTION OF RELATED ART

U.S. Pat. No. 6,719,048, issued to Rogerio Ramos et al on Apr. 13, 2004, discloses a separation method employing gravity in which a produced oil-water mixture is retained in the downhole body of an inclined separator for a relatively short dwell-time followed by pumping oil and gas to the surface while disposing of separated water to a discharge zone in the separator body, following which the water is pumped into a selected underground formation to assist in repressuring the oil and gas bearing formation. Detectors are positioned at the inlets to the separator to distinguish between the oil and water components in order to provide early separation.

U.S. Pat. No. 6,868,907, issued to Gunder Homstvedt et al on Mar. 22, 2005, describes a downhole gravity separator in which a separator chamber is inclined in the downhole producing portion of a wellbore in order to take advantage of the density differences of the oil and water.

U.S. Pat. No. 6,691,781, issued to Alexander Grant et al on Feb. 17, 2004, discloses a production fluid separation method and apparatus including a gravity-driven downhole fluid separator having a gas/liquid separator and an oil/water separator in which the separated gas is mingled with separated oil, and the gas and oil flow together to the surface while the separated water is reinjected into the formation. Turbine driven pumps are required which are powered by liquid under pressure from the surface.

U.S. Pat. No. 7,389,816, issued to Louis Cognata on Jun. 24, 2008, discloses a three-phase oil/gas/water separator in which oil, gas and water are introduced into the separator above an isolation packer separating the downhole assembly into what is defined as a "first vertical length" and a "second vertical length", the separation occurring immediately below a downhole pump. The gas is permitted to separate from the oil/water mixture in the "first vertical length" from where it will bubble to surface within the casing. The oil/water mixture is pumped at high pressure into the "second vertical length" of the assembly below the isolation packer where gravity separation of the oil and water takes place, the oil being pumped to surface within the tubing in the "first vertical length" downhole assembly.

The present invention is believed to be an improvement over existing methods and apparatus of the above-described type.

SUMMARY OF THE INVENTION

In accordance with one aspect, the present invention relates to an apparatus for separating hydrocarbons and water produced from an underground formation comprising: a casing for lining a borehole in the formation; a tubing string in said casing defining an annulus with said casing; first perforations in said casing at a production zone of said borehole for introducing production fluid into the casing; second perforations in said tubing string for admitting production fluid from the casing into said tubing string; a packer in said annulus separating said first perforations from said second perforations; a first check valve in said tubing string above said packer for admitting production fluid under pressure from said tubing string into said annulus where the water can separate by gravity from the hydrocarbons; and a second check valve in said tubing string above said first check valve for admitting separated hydrocarbons from said annulus into said tubing string for passage to the top of the borehole.

In accordance with another aspect, the invention relates to a method of separating hydrocarbons and water produced from an underground formation utilizing an annulus between a casing and a tubing string in a wellbore as a separation chamber comprising the steps of: introducing production fluid through the casing into the tubing string at a production level in the formation; passing the production fluid through a lower check valve into the annulus between the casing and the tubing string where the water is separated from the hydrocarbons by gravity; passing separated hydrocarbons into the tubing string through an upper check valve to flow to surface, and injection separated water into the formation at a water injection level in the formation isolated from the production level.

In accordance with yet another aspect, the invention provides a check valve for use on the inner of a pair of coaxial tubes carrying fluid under pressure comprising a tubular mandrel for forming a section of the inner tube; a plurality of perforations in said tubular mandrel; a perforated housing mounted on said mandrel covering the perforations; a flexible, resilient, cylindrical membrane in said housing; and a porous, solid, tubular membrane coaxial with said cylindrical membrane in said housing, whereby fluid flowing through the valve passes around the cylindrical membrane and through the porous membrane into or out of the inner tube.

The invention described herein is unique in that oil/gas/water separation occurs in an annulus in the wellbore between production tubing and the well borehole (whether cased or open hole) over the full length of the annulus from the production level to the surface. While the production of fluids in an oil well typically includes oil and water, it will be appreciated that the method and apparatus described herein can be used effectively in hydrocarbon wells producing large quantities of natural gas.

The method of this invention utilizes the entire length of the hydrocarbon/water column in the annulus from the production level to the surface, taking advantage of the density difference between the oil, gas and water produced, rather than the limited length of a downhole separator chamber (as disclosed in the prior art) in order to more completely separate the oil and gas components and to permit the water component to be discharged at an exit from the separator chamber into a selected water level. Operating costs of production are reduced by creating a relatively long distance over which separation occurs in the wellbore annulus, thereby achieving production of clean oil and/or gas at the surface, and the reinjection of water into the water formation. When separated, the water is maintained separate and is not allowed to re-emulsify with the oil and gas before discharge.

In accordance with the method of the present invention, hydrocarbons are produced from a wellbore to which an emulsion of oil, gas and water is delivered under downhole formation pressure and in which a previously determined water discharge level is known to be located below the hydrocarbon producing level in the formation, this being the normally occurring geological formation encountered in hydrocarbon production.

In accordance with a second embodiment of this invention, in which the identified water injection level in a formation is located above the hydrocarbon production level, a different embodiment of a separation chamber is employed.

Different embodiments of the invention are used in horizontal completions without departing from the inventive concept. In each adaptation, a separation chamber is positioned in a vertical portion of the wellbore adjacent to the horizontal portion of the wellbore. In each variation, separation of hydrocarbons and water takes place in the vertical portion of the wellbore, while water reinjection will normally occur in the horizontal portion, as dictated by the geological conditions in that location.

Downhole oil/water separators are frequently designed with mechanically operated separation assisting devices such as cyclones powered by downhole power drive means such as described in U.S. Pat. No. 6,080,312 issued to Bill Bowers et al on Jun. 27, 2000 and U.S. Pat. No. 6,336,504 issued to Francisco Alhanatic et al on Jan. 8, 2002. The present invention relies on the entire length of the tubing string and an annulus between the casing and the tubing string to effect gravity driven hydrocarbon/water separation. With a pump positioned downhole at the production level co-operating with a system of check valves in a pump chamber and advantageously using the full length of the annulus between the tubing and the casing as the separator, effective hydrocarbon/water separation is accomplished as follows:

- on the pump upstroke, hydrocarbon and water from the production zone enter the pump chamber through an inlet check valve;
- on the following downstroke, the check valve closes and tubing string mounted check valves open to discharge the hydrocarbon/water emulsion into the surrounding annulus;
- water accumulates in the annulus and later in the tubing until it reaches sufficient hydrostatic pressure and starts descending by gravity within the annulus and a water discharge by-pass to enter a water discharge level of the geological formation;
- gas and/or oil accumulating in the tubing and casing rise to the surface for recovery; and
- the discharge of both the water and hydrocarbon is achieved by formation or pump pressure developed in the separation assembly.

The gravity separation of this invention utilizes an annular height of fluid averaging from a few hundred feet to thousands of feet, within which the separation of hydrocarbons from the water takes place.

It has been found that the system herein described is suited for thousands of barrels of water per 24 hours and oil production at the rate of hundreds of barrels per day from depths of 1,000 to 20,000 plus feet. The features described above will be apparent from the following descriptions, claims and drawings.

DETAILED DESCRIPTION OF THE INVENTION

Figure 1:
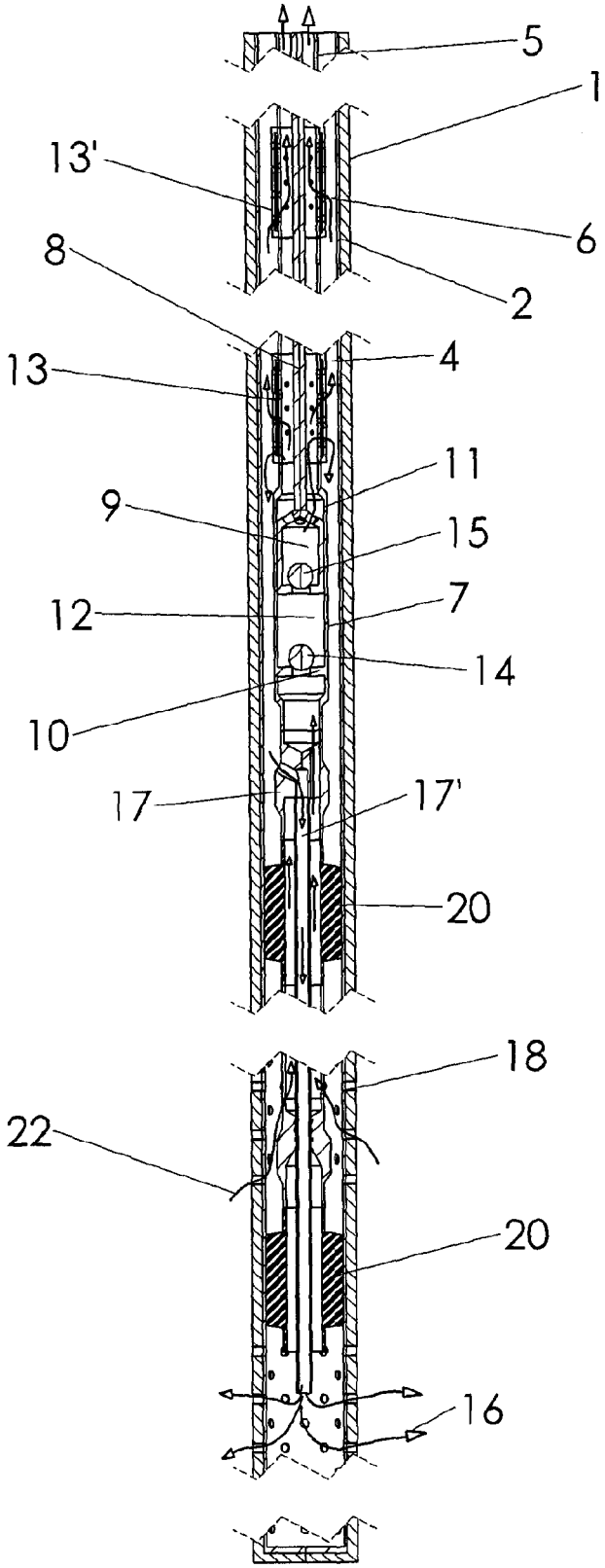
FIG. 1 is a longitudinal sectional view of an apparatus for producing and separating hydrocarbons and water from a vertical wellbore.

In the following detailed description, wherever possible the same reference numerals have been used to identify the same or similar elements.

With reference to FIG. 1, the first embodiment of the apparatus of the present invention is shown in a vertical oil or oil with gas wellbore 1. A casing 2, normally cemented in situ in the wellbore 1 in a conventional manner, defines a borehole passage 4. Production tubing 5 located centrally in the passage 4 defines an annulus 6 with the casing 2. The casing 2 and the production tubing 5 extend to the surface (not shown) at the top of the borehole 1. The well, drilled down to an oil or oil and gas-bearing formation (not shown), is normally several thousand feet in depth. The top of the borehole 1 is normally capped except for the tubing 5, which is coupled by surface equipment to production tankage or pipeline. The bottom of the casing 2, unless in openhole completion, is normally terminated with a cement plug at the bottom of the passage 4.

A bottomhole pump 7 is located several feet above a production zone indicated by arrows 22. FIG. 1 shows a reciprocating piston pump 7 in which a piston 9 reciprocates axially relative to the tubing 5. However, different types of downhole pump designs may be used. The downhole pump 7 is operated by a pump rod 8, and is normally driven by an above ground electrical pump drive. The pump piston 9 reciprocates between a piston seat 10 and an upper piston location 11, the position of which is controlled from the surface, depending on downhole conditions such as the characteristics of the oil/gas/water production for the well. The pump piston 9 reciprocates in a chamber 12 in the tubing 5. In operation, the pump 9 discharges a quantity of oil/gas/water in the chamber 12 through a slip-type check valve 13 and engages a lower pump check valve 14 located on the piston seat 10. The slip-type check valve 13 includes a flexible, resilient sleeve around a section of the tubing 5 containing holes. The sleeve expands and disengages from the tubing 5 to permit outward flow of the hydrocarbon/water mixture, and reseals against the tubing 5 upon release of the pump expansion pressure. An upper check valve 15 in the chamber 12 seals the latter against discharge into the lower end of the tubing 5.

The annulus 6 is open to upward oil and gas flow to the surface and downward water flow to a water injection level indicated by arrows 16 via a flow diverter or by-pass 17 and a by-pass water flow conduit 17' for discharging water into a level of the geological formation at the bottom of the casing 2. Production fluid is admitted into the casing 2 through perforations 18 and into the tubing 5 via a second check valve 13'. The spacing between the check valves 13 and 13' is substantial, usually at least 2000 feet. By providing a lengthy annulus 6 between the upper and lower check valves 13 and 13' gravity can do its work of effecting separating of water from hydrocarbons. Isolation packers 20 seal the annulus 6 above and below the production zone 22 preventing downward discharge of production fluid into the bottom of the borehole 1.

Figure 2:
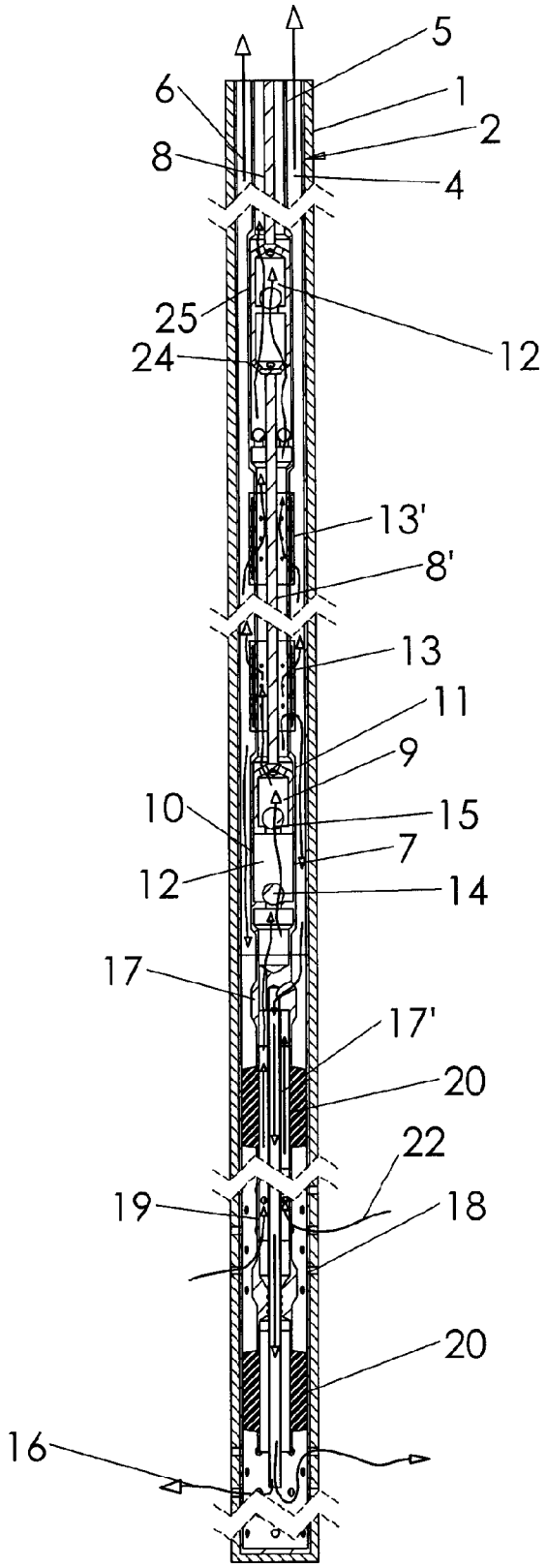
FIG. 2 is a longitudinal sectional view of a second embodiment of the apparatus for producing and separating hydrocarbons and water from a vertical wellbore.

The apparatus of FIG. 2 is similar to that of FIG. 1 except that it is intended for use in a well that does not maintain sufficient pressure to lift the separated oil to the surface. Slip-type check valves 13 and 13' in the upper portion of production tubing 5 between the pump 7 and a second pump 24 allow separated oil from annulus 6 to enter the pump 24, which is connected to an upper sucker rod 8 and operated simultaneously with the bottomhole pump 7. Thus, there are two downhole pumps 24 and 7 defining a dual rod pump piston 25 operated by sucker rods 8 and 8'. The pump piston 25 discharges the separated oil into the production tubing 5 from whence it flows to surface tanks or pipeline. In the apparatus of FIG. 2, the water injection level 16 also lies at the bottom of the casing 2.

In the apparatus of FIG. 2, oil/gas/water enters the casing 1 at the location above the lowermost packer 20, which separates the production zone 22 from the lower water injection zone 16. The mixture enters the tubing 5 through perforations 19, flows upwardly through the flow diverter 17 and a pump 7, following which the mixture passes into the channel 4 via a valve 13. The fluid then flows through a second valve 13' into the second pump 24, and from the pump 24 to the surface. Water separating from the oil and gas flows outwardly through the valve 13 downwardly in the casing and through the diverter 17 into the bypass conduit 17', which exits the bottom end of the tubing 5 for discharge at the bottom of the casing 2.

Figure 3:
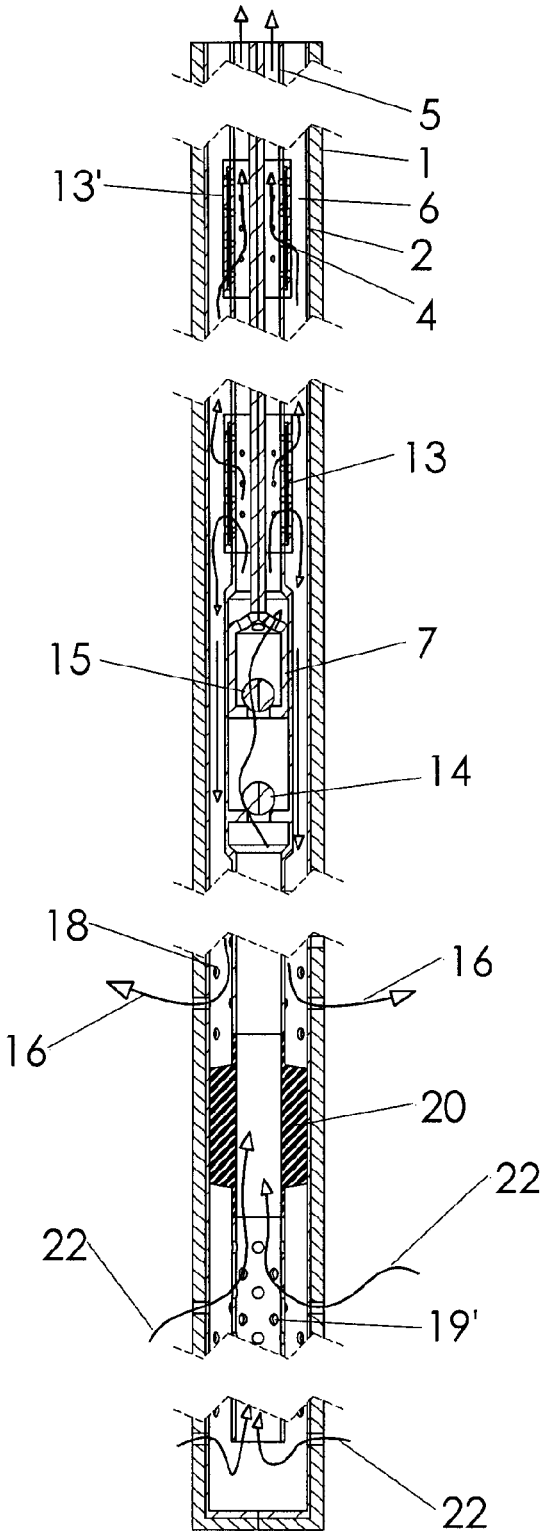
FIG. 3 is a longitudinal sectional view of a third embodiment of the apparatus of the present invention.

In the apparatus of FIG. 3, the water injection level or zone 16 lies above the production zone 22 and the perforations 18 in the casing 2 discharge water directly into the water injection level 16. Production fluid passing through the bottom end of the casing 1 flows into the tubing 5 via perforations 19' and upwardly through the pump 7. Above the pump 7, the fluid mixture passes through a valve 13 into the annulus 6, where the water separates from the oil and gas. The water flows downwardly through the annulus 6 for discharge through perforations 18 into the water injection level 16 which is separated from the production level 22 by a packer 20. The oil/gas rises in the annulus 6 and enters the tubing 5 check valve 13' for discharge to the surface.

Figure 4:
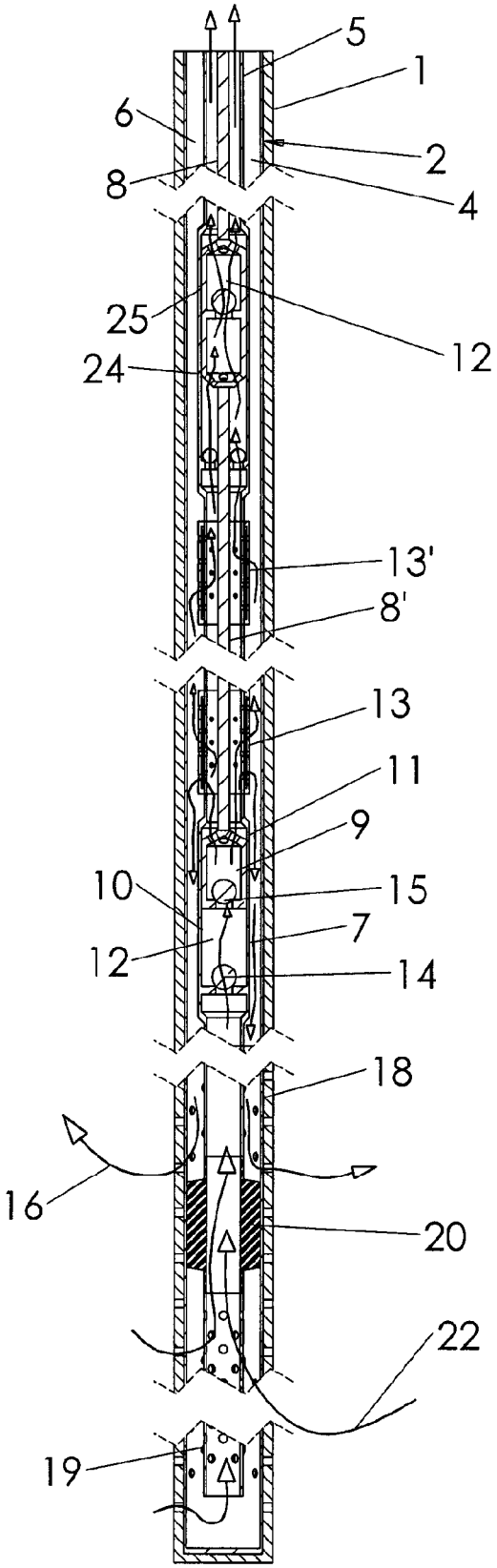
FIG. 4 is a longitudinal sectional view of a fourth embodiment of the apparatus of the present invention.

The apparatus of FIG. 4 is similar to that of FIG. 3 except that it is intended for use in a well which cannot maintain sufficient pressure to lift separated oil to surface. Production fluid enters the bottom of the casing 1 and the tubing 5 through perforations 19 and water is discharged at injection level 16 separated from the production level 22 by a packer 20. The production fluid passes through the bottomhole pump 7 and valve 13 into the annulus 6 where water is separated from the gas and oil. The gas and oil rises in the annulus 6 and re-enters the tubing 5 via valve 13'.

The slip-type check valve 13 in the upper portion of the production tubing 5 allows separated oil from the annulus 6 to enter the dual sucker rod pump 24 operated simultaneously with the bottomhole pump 7. The dual rod pump piston 25 discharges the separated oil into production tubing 5 from where it flows to surface tanks or pipeline.

Figure 5:
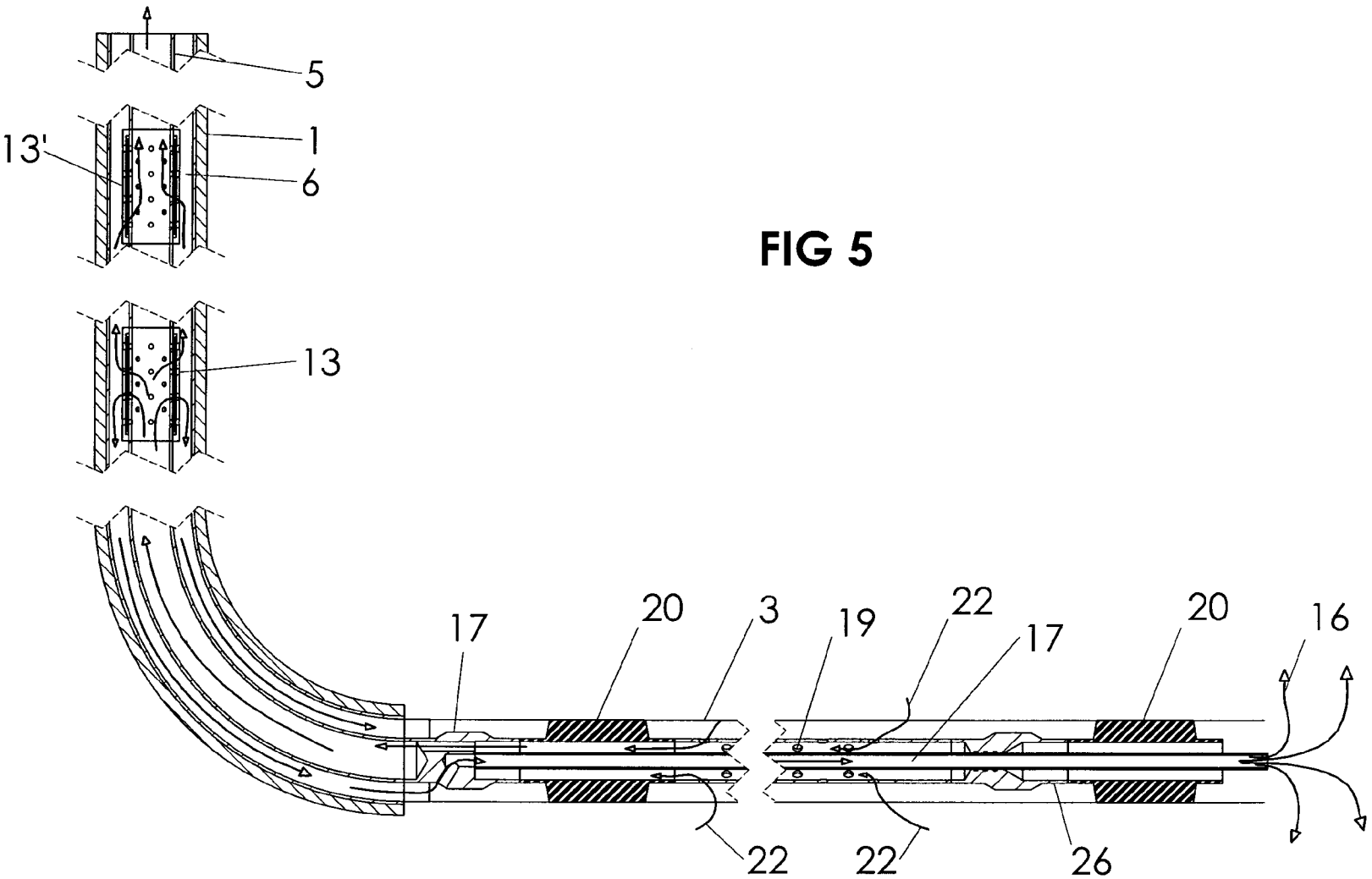
FIG. 5 is a longitudinal sectional view of a fifth embodiment of the apparatus of the present invention.

In each of FIGS. 5. 7 and 9, the horizontal portion of the wellbore is shown as an "openhole" completion. It will be recognized by those skilled in well drilling technology that in openhole completions one or more liners may be run into the wellbore where for example, unstable rock or sands require additional support.

Figure 7:
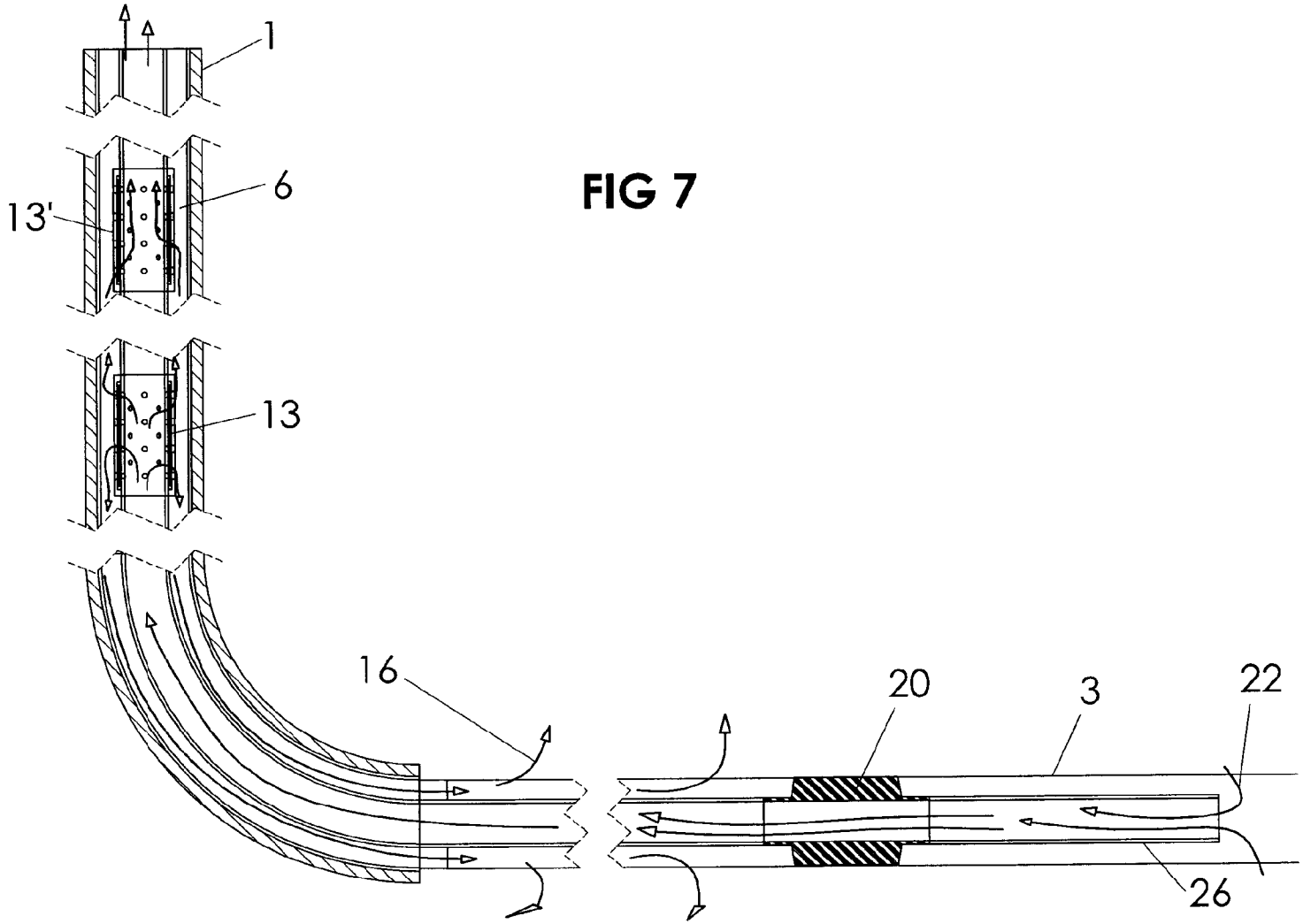
FIG. 7 is a longitudinal sectional view of a seventh embodiment of the apparatus of the present invention.
Figure 9:
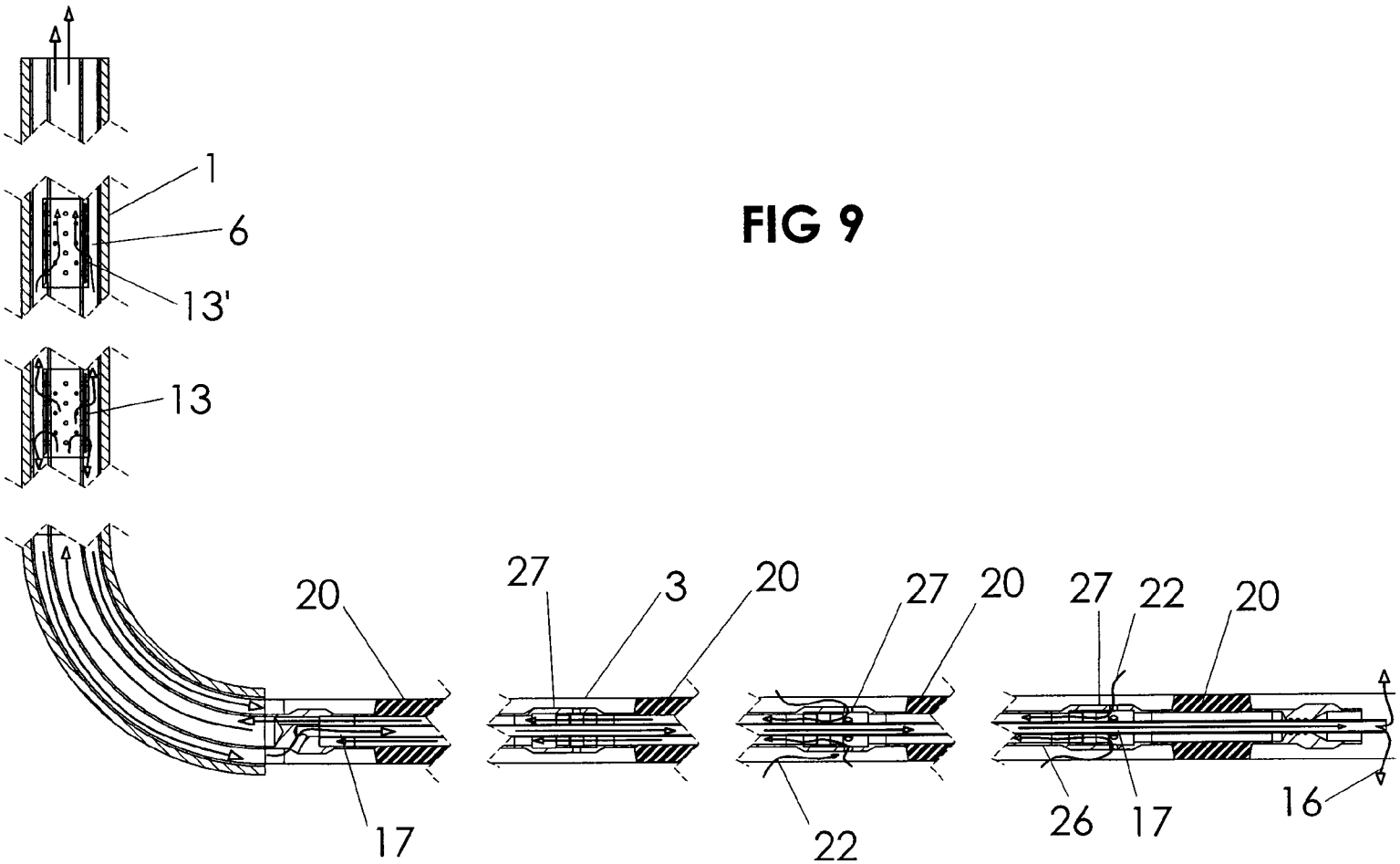
FIG. 9 is a longitudinal sectional view of a ninth embodiment of the apparatus of the present invention.

In the apparatuses shown in FIGS. 5, 7 and 9, the borehole 1 goes from a vertical leg to a horizontal leg to access a production formation which can be more economically developed with a horizontal open hole or a liner 3 and extended suction tubing 26. The well completion apparatus shown in FIG. 5 is similar to that shown in FIG. 1 except for the orientation of the downstream portion of the wellbore 1 which lies generally horizontally.

Production fluids enter the open hole or liner 3 and extended suction tubing 26 at perforations 19 to admit produced fluids into the lower end of the tubing. Isolation packers 20 seal the annulus 6 and the extended suction tubing 26 from downstream discharge into the water injection level 16 and direct the production fluids upstream for discharge into the annulus 6 through ports in the check valve 13. Thus, the isolation packers 20 segregate the production zone 22 from all other pressure sources including hydrostatic and formation pressures.

Figure 6:
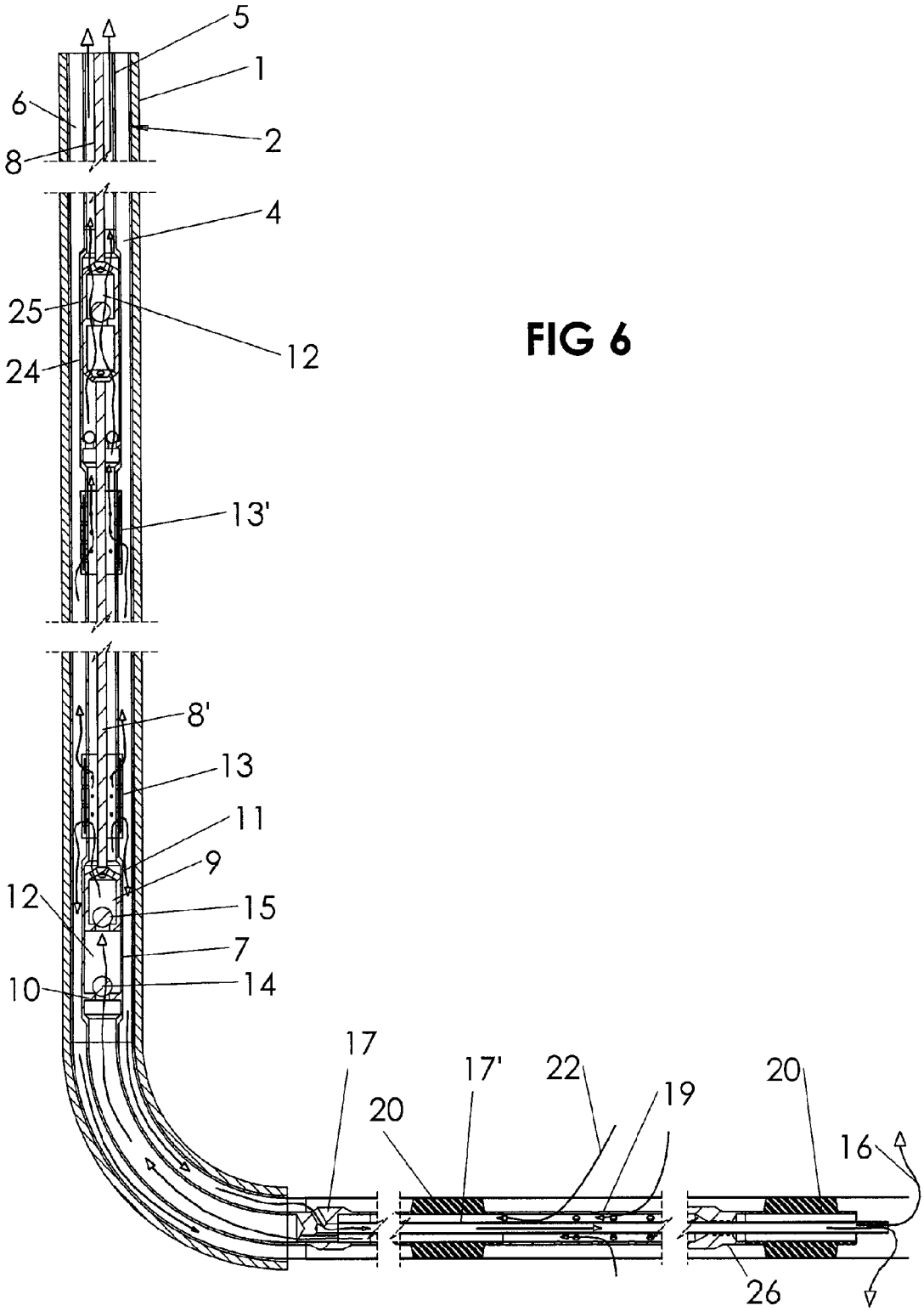
FIG. 6 is a longitudinal sectional view of a sixth embodiment of the apparatus of the present invention.

The embodiment shown in FIG. 6 is similar to that of FIG. 5 except that it is used in a well which does not maintain sufficient pressure to lift the separated oil to surface. A check valve 13' in the upper portion of the production tubing 5 allows separated oil to enter dual sucker rod pump 24 connected to the sucker rod 8' for simultaneously operating a bottom hole pump 7. The dual rod pump piston 25 discharges the separated oil into production tubing 5 from whence it flows to surface tanks or pipeline.

The well completion apparatus shown in FIG. 7 is similar to that shown in FIG. 5 except that the water reinjection location or level 16 lies upstream of the production zone 22 and is charged with reinjection water on the downstream flow from the part of check valve 13. Oil, gas and water from the production zone 22 are directed upwardly into the vertical leg of the casing where separation of the oil gas and water occurs.

Figure 8:
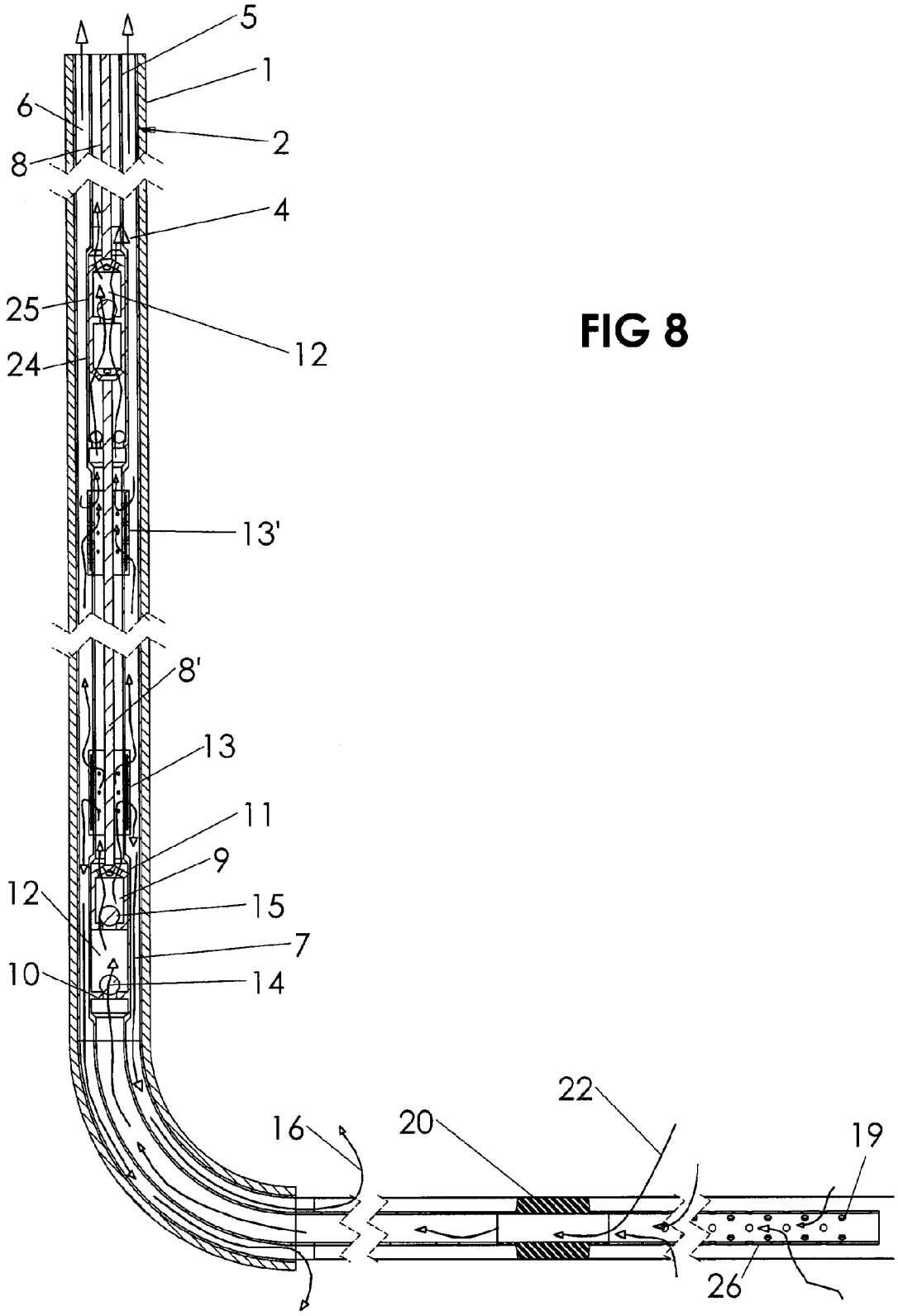
FIG. 8 is a longitudinal sectional view of an eighth embodiment of the apparatus of the present invention.

The apparatus of FIG. 8 is similar to that of FIG. 7 except that it is used in a well which does not maintain sufficient pressure to lift separated oil to surface. A check valve 13' in the upper portion of production tubing 5 allows separated oil to enter a dual sucker rod pump 24 connected by a sucker rod 8' to a bottom hole pump 7 to simultaneously operate such bottom pump. The dual rod pump piston 25 discharges separated oil into the production tubing 5 from where it flows to surface tanks or pipeline.

A vertical modification of the vertical-to-horizontal production apparatus is shown in FIG. 9, wherein production is taken from multiple zones using a plurality of isolation packers 20 in the horizontal portion of the wellbore 1. Selectively open/close port valves 27 operated by surface controls (not shown) the construction and operation of which are well established and known to those skilled in the art to which this invention relates, allow production to be taken selectively from different sections of the production zone 22.

Figure 10:
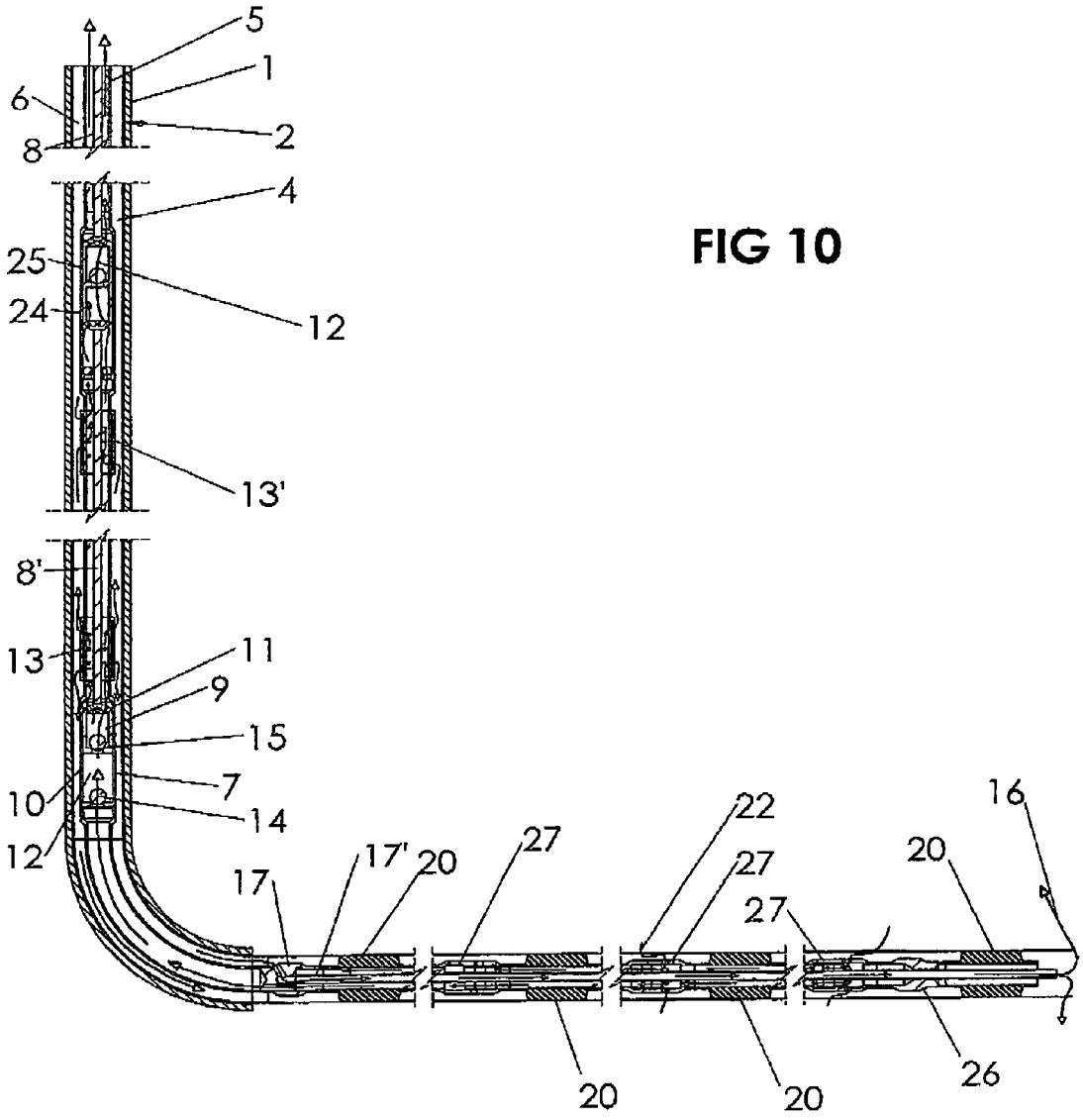
FIG. 10 is a longitudinal sectional view of a tenth embodiment of the apparatus of the present invention.

The apparatus shown in FIG. 10 is similar to that of FIG. 9 except that it is used in a well which does not maintain sufficient pressure to lift separated oil to the surface. A check valve 13' in the upper portion of the production tubing 5 allows separated oil to enter the dual sucker rod pump 24 connected by sucker rod 8' to a bottom hole pump 7 to simultaneously operate such bottom pump. The dual rod pump piston 25 discharges separated oil into the production tubing 5 from whence it flows to surface tanks or pipeline.

Figure 11:
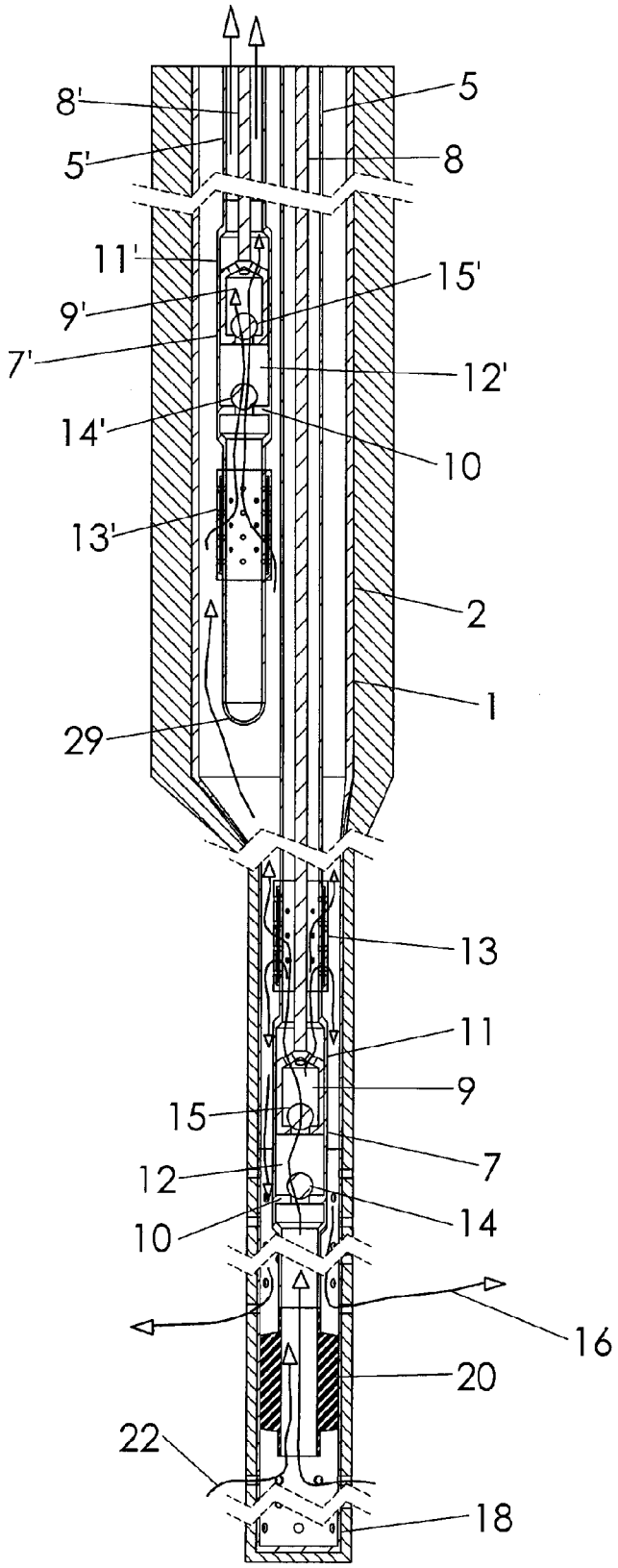
FIG. 11 is a longitudinal sectional view of an eleventh embodiment of the apparatus of the present invention.

The embodiment of the apparatus shown in FIG. 11 is used for multi-zone completion of a wellbore where the well does not maintain sufficient pressure to lift separated oil to surface. The upper end of the dual tubing string apparatus can be added to the upper end of the apparatus shown in FIG. 1, 2, 5, 7 or 9. Second tubing 5' has a closed bottom end 29 at the separated oil level of the annulus 6. Separated oil enters the tubing 5' through a slip-type check valve 13' and a pump 7' through a pump check valve 14'. A pump piston 9' discharges the separated oil into production tubing 5' from whence it flows to surface tanks or pipeline.

Figure 12:
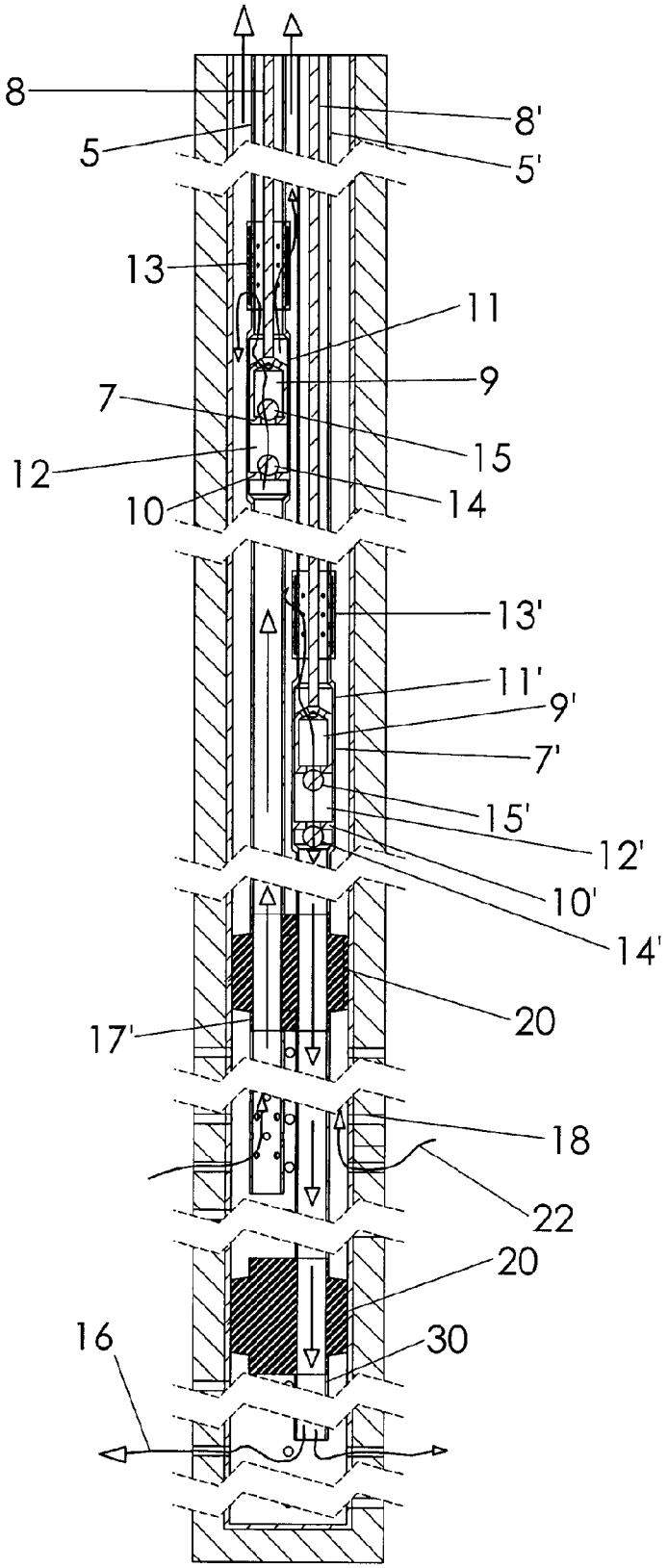
FIG. 12 is a longitudinal sectional view of a twelfth embodiment of the apparatus of the present invention.

The apparatus shown in FIG. 12 used in the multi-zone completion of a wellbore that requires pump pressure to discharge separated water. The additional elements of the apparatus can be added to the embodiments of the invention shown in FIG. 1, 3, 5, 7 or 9. As indicated by arrow 22, a gas/oil/water emulsion from a production zone enters the extended suction tubing 26 and passes through a downhole pump 7 via lower pump check valve 14. The pump piston 9 discharges the emulsion through the check valve 13 into the annulus 6 for separation. The gas and oil rise to the surface. Separated water flows down and enters the second tubing string 5' via a second slip-type check valve 13'. A second downhole pump 7' drives the separated water through a by-pass water flow conduit 30 to a location below the isolation packer 20 to the water injection zone 16.

Figure 13:
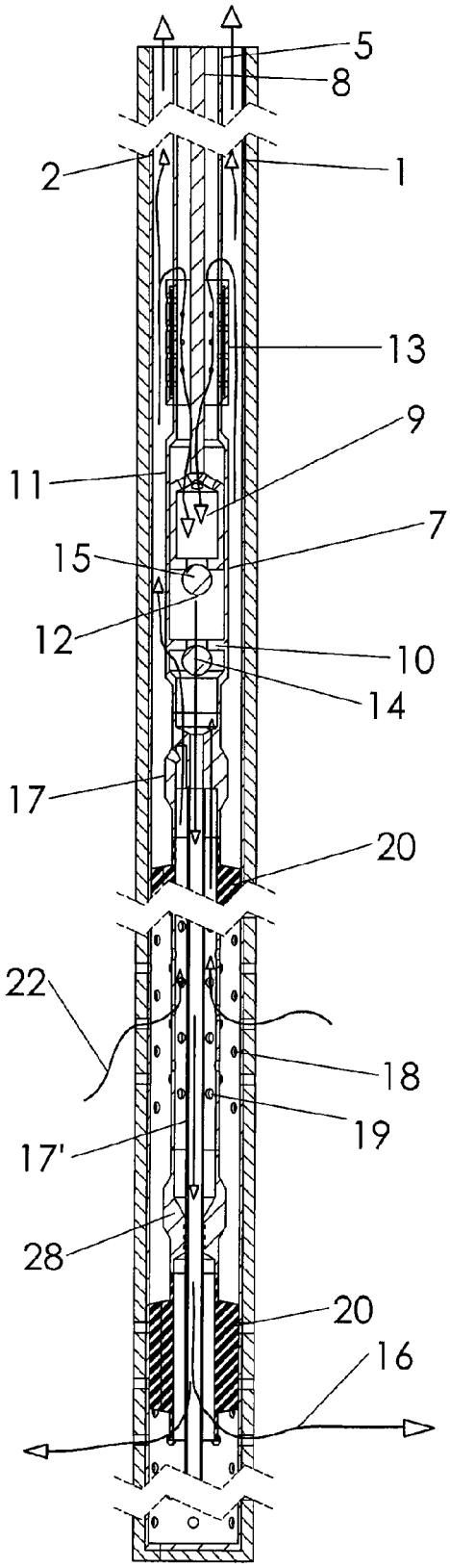
FIG. 13 is a longitudinal sectional view of a thirteenth embodiment of the apparatus of the present invention.

The apparatus shown in FIG. 13 is intended for use in a gas well that requires pump pressure to discharge the separated water. The apparatus can be deployed in a vertical or horizontal wellbore including multiple zone completions. As indicated by arrow 22 gas and water from production zone enter the annulus 6 via perforations 18 in the casing 1, perforations 19' in the tubing 5 and a flow diverter or by-pass 17. The gas flows to the surface. Separated water flows into the production tubing 5 via the check valve 13. The pump 7 drives the separated water through the by-pass water flow 17 to a location below the isolation packer 20 to the water injection zone 16.

Figure 14:
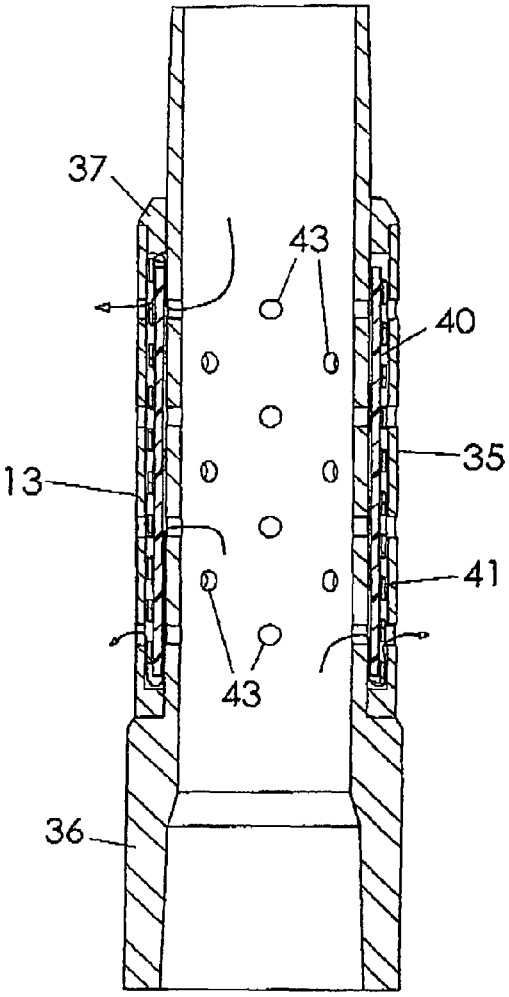
FIGS. 14 and 15 are longitudinal sectional views of slip-type check valves used in the apparatus of the present invention.

Referring to FIG. 14, a slip-type check valve 13 in accordance with the invention includes a perforated housing 35 mounted on a ported mandrel 36 which forms part of a tubing string. The housing 35 is held in position by an end cap 37. The housing 35 contains a flexible, resilient, cylindrical membrane 40 surrounded by a tubular, porous solid membrane 41. Fluid and/or gas pressure within the mandrel 36 expands the flexible membrane 40 away from the mandrel 36 limited by the porous membrane 41. Fluid and gas flow through mandrel ports 43 around the flexible membrane 40 and through the perforated housing 35. When pressure within the mandrel 36 drops, the flexible solid membrane 40 contracts to seal against the mandrel 36 to prevent reverse flow.

Figure 15:
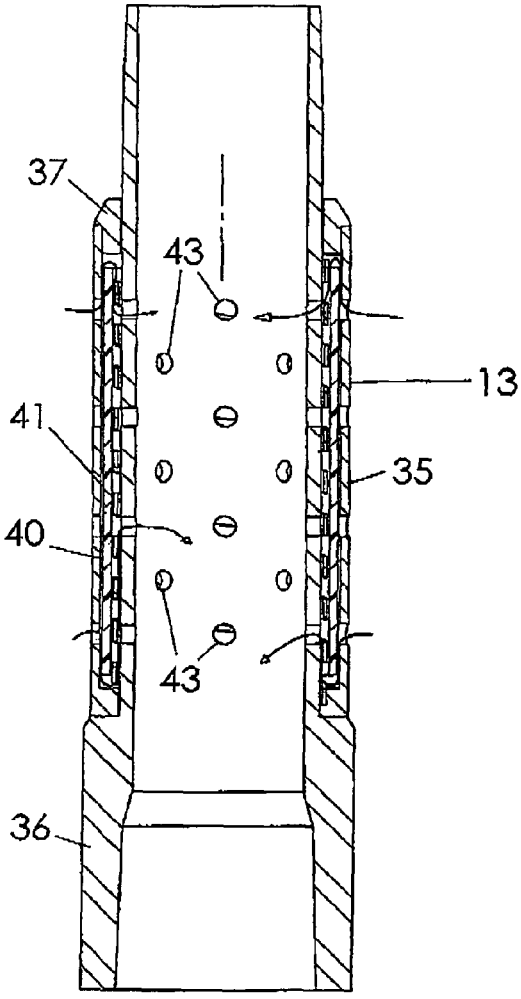

The check valve of FIG. 15 is identical to the valve of FIG. 14, except that the locations of the membranes 40 and 41 in the housing 36 are reversed, i.e. the membrane 40 abuts the housing 35 and the membrane 41 is sandwiched between the membrane 40 and the mandrel 36. Fluids and gas flowing from the outside through the perforated housing 35 pass around the flexible membrane 40 and through the membrane 41 into the ported inner mandrel 36. When pressure within the mandrel 36 is higher than the external pressure the flexible membrane 40 expands to seal against the inner wall of the perforated housing 35 to prevent reverse flow.

In certain cases, the origin of the produced fluids may be in multilateral locations drilled from the main wellbore 1, using offsetting whipstock or horizontal drilling techniques familiar to those knowledgeable in the art.

It will be appreciated that in either vertical or horizontal completions the bottomhole pump 7 as shown in FIG. 1, may be used to increase pressure in the separation annulus 6 in order to reinject produced water back into the water injection level 16 and to deliver the hydrocarbon production to the surface if the pressure within the hydrocarbon formation is insufficient.

It will also be appreciated that under certain conditions, in either vertical or horizontal completions, where exceptionally high water volumes are present, a bottomhole pump 7 may be required with its only purpose being the reinjection of water into the water reinjection level 16 through the by-pass water flow conduit 17.

Volumes of gas may be produced along with oil. The gas may be separated from the oil at the surface in conventional oil/gas separation systems.

The invention claimed is:

1. An apparatus for separating hydrocarbons and water produced from an underground formation comprising:

a casing for lining a borehole in the formation;

a tubing string in said casing defining an annulus with said casing;

first perforations in said casing at a production zone of said borehole for introducing production fluid into the casing;

second perforations in said tubing string for admitting production fluid from the casing into said tubing string;

third perforations in said casing for discharging separated water from the annulus into the formation at an injection zone;

a first packer in said annulus separating said first perforations from said third perforations;

a first check valve in said tubing string above said packer for admitting production fluid under pressure from said tubing string into said annulus where the water separates by gravity from the hydrocarbons for discharge through said third perforations; and a second check valve in said tubing string above said first check valve for admitting separated hydrocarbons from said annulus into said tubing string for passage to the top of the borehole.

2. The apparatus of claim 1, including a flow diverter in said tubing string between said first packer and said first check valve for directing production fluid upwardly in the tubing string to said first check valve and directing separated water from the annulus downwardly; and a bypass conduit connected to said flow diverter in said tubing string for conveying separated water to a water discharge zone in the formation.

3. The apparatus of claim 2 including a downhole pump in said tubing string between said flow diverter and said first check valve for pumping production fluid upwardly to said first check valve.

4. The apparatus of claim 1, including a second packer spaced apart from said first packer in said annulus, the casing between the first and second packers containing said first perforations and the casing beneath the packers containing the third perforations.

5. The apparatus of claim 1, wherein the first packer is located above said first and second perforations and below said third perforations for a formation in which the production zone is above the packer and the injection zone is beneath the packer.

* * * * *